US006989107B1

(12) United States Patent
Skold

(10) Patent No.: US 6,989,107 B1
(45) Date of Patent: Jan. 24, 2006

(54) MECHANICAL WORKING IN THE PRESENCE OF A MULTI-PURPOSE COOLING LUBRICANT

(75) Inventor: Rolf Skold, Stenungsund (SE)

(73) Assignee: AB Chem Dimension, Stenungsund (SE)

( * ) Notice: Subject to any disclaimer, the term of this patent is extended or adjusted under 35 U.S.C. 154(b) by 0 days.

(21) Appl. No.: 09/889,495

(22) PCT Filed: Jan. 13, 2000

(86) PCT No.: PCT/SE00/00035

§ 371 (c)(1),
(2), (4) Date: Jul. 18, 2001

(87) PCT Pub. No.: WO00/42135

PCT Pub. Date: Jul. 20, 2000

(30) Foreign Application Priority Data

Jan. 18, 1999 (SE) ..... 9900112

(51) Int. Cl.
*C09K 5/00* (2006.01)

(52) U.S. Cl. ..... 252/71; 252/73; 252/79; 508/110; 508/431

(58) Field of Classification Search ..... 252/71, 252/73, 79; 508/110, 431
See application file for complete search history.

(56) References Cited

U.S. PATENT DOCUMENTS 4,342,658 A * 8/1982 Tincher et al. ..... 252/35.5
4,670,168 A 6/1987 Laemmle et al.
6,432,890 B1 * 8/2002 Scold ..... 508/431
6,592,775 B1 * 7/2003 Scold ..... 252/73
6,602,833 B1 * 8/2003 Scold ..... 508/423

FOREIGN PATENT DOCUMENTS

DE A12943963 5/1981
EP A10120822 10/1984

* cited by examiner

*Primary Examiner*—Charles Boyer
*Assistant Examiner*—D. G. Hamlin
(74) *Attorney, Agent, or Firm*—Birch, Stewart, Kolasch & Birch, LLP

(57) ABSTRACT

A method for the mechanical working of metals and alloys which comprises conducting the mechanical working in the presence of an aqueous cooling lubricant having a pH of 6–10 and containing a phosphate ester of the formula $$R_1(\text{oxyalkylene})_n OP(O)(X)(OH) \quad (I),$$

or $$(HO)_2(O)P\text{-}(\text{oxyalkylene})_m OP(O)(OH)_2 \quad (II),$$

where $R_1$ is an alkyl group with 1–12 carbon atoms, oxyalkylene is a group containing 2–4 carbon atoms, n is a number from 1–20, X is hydroxyl, $R_1O$ or $R_1(\text{oxyalkylene})_n O$, where $R_1$, oxyalkylene and n have the meanings mentioned above, and m is a number from 4–40, or a salt thereof, and an alkenyl substituted succinic acid of the formula $$HOOCCH(R_2)CH_2COOH \quad (III),$$

where $R_2$ is an alkenyl group with 4–10 carbon atoms, or a salt thereof, or a mixture of any of the compounds I, II and III.

12 Claims, No Drawings

MECHANICAL WORKING IN THE PRESENCE OF A MULTI-PURPOSE COOLING LUBRICANT

This application is the national phase under 35 U.S.C. §371 of PCT International Application No. PCT/SE00/00035 which has an International filing date of Jan. 13, 2000, which designated the United States of America and was published in English.

BACKGROUND OF THE INVENTION

The present invention relates to a multi-purpose aqueous cooling lubricant suitable for the mechanical working of many different metals and alloys. The cooling lubricant, containing as essential components a phosphate ester compound and a dicarboxylic acid, contributes to excellent corrosion inhibiting and lubrication properties.

The mechanical working of metals is often performed in the presence of an aqueous cooling lubricant. A disadvantage of many aqueous cooling lubricants is that they frequently contain an iron corrosion inhibitor, such as monoethanolamine, diethanolamine or triethanolamine, which has a detrimental effect and causes discoloration and dissolution when used with cobalt, copper, aluminum, lead or zinc or alloys thereof. Besides the corrosion, any dissolved metal may also constitute a human health and environmental hazard and is difficult to remove from water in the process of disposal of the cooling lubricant.

In order to mitigate the negative effects of the alkanol amine, anionic surface active components with long aliphatic groups, such as groups with 14–44 carbon atoms have been added. Exemplary components are phosphate esters, fatty acids and dinner acids. Their protective action depends on the formation of water-insoluable, organic layers on the metal surfaces. If, however, dissolved di- or trivalent metals exist in the cooling lubricant, the aninic components will form water-insoluable salts with these metal ions. This may sometimes further increase the corrosion inhibiting effect, but it will also lead to the formation of an undesirable sticky precipitation, which, e.g., tends to interfere with the purification of the cooling lubricant. Another drawback is the difficulty to remove the hydrophobic layers formed on the metal surfaces. If they are not removed, they could cause problems in the subsequent surface treatments, for example pickling, phosphatizing, galvanizing or other metal depositing processes. The presence of the long chain anionic components may also cause undesirable foaming and scum.

U.S. Pat. No. 4,315,889 discloses a method of reducing the release of cobalt by performing the metal working in the presence of a cooling lubricant containing, as an active component, a specific triazole or thiadiazole compound. However, since these active compounds are consumed in the presence of ethanolamines, the aqueous cooling lubricant has to be regularly upgraded.

EP-A-0180561 describes the use of a tertiary alkanol amine compound for reducing the release of cobalt. According to the application, the tertiary alkanol amine compound can advantageously be combined with carboxylic acids to further increase the protection against the release of cobalt and the corrosion of iron.

DE-OS-2 943 963 discloses the use of an alkanolamine salt of alkenyl succinic acid as a corrosion inhibitor in aqueous solutions and U.S. Pat. No. 4,670,168 describes a metalworking composition containing a water-soluable polyalkylenegylcol and a neutralized or partially neutralized alkenyl succinic acid.

SUMMARY OF THE INVENTION

According to the present invention it has now been found that the above mentioned problems may be reduced or eliminated by using a combination of a phosphate ester and a dicarboxylic acid as a lubricant and an anti-corrosion agent in an aqueous metal working liquid, whereby the dissolution and discoloration of several metals, such as cobalt, copper, zinc, lead, aluminum and iron, and their alloys are effectively hampered. In more detail, the present invention relates to a process for the mechanical working of metals, which is performed in the presence of an aqueous cooling lubricant having a pH of 6–10 and containing a phosphate ester of the formula

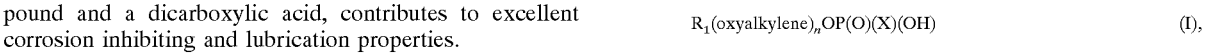

$$R_1(\text{oxyalkylene})_n OP(O)(X)(OH) \quad \text{(I)},$$

or

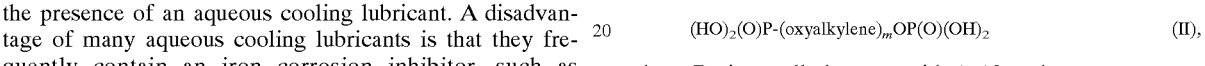

$$(HO)_2(O)P\text{-}(\text{oxyalkylene})_m OP(O)(OH)_2 \quad \text{(II)},$$

where $R_1$ is an alkyl group with 1–12 carbon atoms, oxyalkylene is a group containing 2–4 carbon atoms, n is a number from 1–20, X is hydroxyl, $R_1O$ or the group $R_1(\text{oxyalkylene})_nO$, where $R_1$, n and oxyalkylene have the above-mentioned meanings, and m is a number from 4–40, or a salt thereof, and an alkenyl substituted succinic acid of the formula

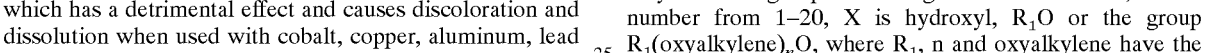

$$HOOCCH(R_2)CH_2COOH \quad \text{(III)},$$

where $R_2$ is an aliphatic group with 4–10 carbon atoms, or a salt thereof, or a mixture the compounds I, II and III. The total amount of compounds I and II is from 0.2 to 5% by weight, preferably 0.4–3% by weight and the amount of compound III is from 0.2 to 5% by weight, preferably 0.4–3% by weight. The salts of the phosphate ester and the succinic acid are preferably formed of monovalent cations, such as potassium and sodium.

In the phosphate esters of formulae I and II, the (oxyalkylene), group and $(\text{oxyalkylene})_m$ group respectively, are suitably selected in such a way that the esters will be water-soluble or easily dispersible in water. Preferably the $(\text{oxyalkylene})_n$ group contains at least partially oxypropylene units and most preferably only oxypropylene units. The aliphatic group $R_1$ can be saturated or unsaturated, straight or branched and contains preferably 2–8 carbon atoms. The group X is preferably a hydroxyl or the group $R_1(\text{oxyalkylene})_nO$. Preferably the phosphate ester of formula I consists of at least 50% by weight of monoesters. In formula II the polyoxyalkylene chain preferably consists at least partially of oxyalkylene groups with 3–4 carbons atoms and m preferably is at least 6, since these diphosphate esters beside the corrosion inhibiting effect give a considerable contribution to the lubrication. Especially suitable are those diphosphate esters, which contain a polyoxypropylene chain with 8–15 oxypropylene units.

The succinic acid of formula III contains an aliphatic group $R_2$ which can be a straight or branched alkenyl. Examples of alkenyl groups are octenyl, decenyl, di(isobutenyl) and tri(propenyl). Preferably the alkenyl group contains 7–9 carbon atoms. The succinic acids of formula III exhibits in addition to their excellent lubrication and anti-corrosion, low foaming, which is of essential importance in a metal working cooling lubricant.

The cooling lubricant can also contain a number of other additives, such as additional corrosion-inhibiting additives and lubricants, pH-regulating or controlling additives, bactericidal agents, viscosity-increasing additives, solubilizers, perfumes, colourants etc.

Examples of suitable additional corrosion inhibitors are amine compounds, such as triazole and thiadiazole compounds and inorganic compounds, such as alkali metal hydroxides and boric acid, and reaction products between boric acid and/or carboxylic acids and organic reactants, such as alkanol amines. The content of these additional corrosion inhibitors may be up to 3% by weight of the cooling lubricant. Although the cooling lubricant containing the anionic surfactants I, II and III has an adequate lubrication ability for most applicants there may be occasions where improved lubrication is desired. Examples of suitable lubricants to be incorporated into a cooling lubricant according to the present invention are those selected from the group consisting of esters or amides of mono- or dicarboxylic acids having at least 12 carbon atoms in the acyl groups, organic aliphatic phosphate esters containing one or two aliphatic groups with 6–18 carbon atoms, nonionic alkylene oxide adducts with a molecular weight above 400, such as polypropylene glycols, glycols of randomly distributed propyleneoxy and ethyleneoxy groups and block polymers of propylene oxide and ethylene-oxide, and mixtures thereof. The content of these additional lubricants may be up to 3% by weight of the cooling lubricant ready for use.

The solubilizers are usually low molecular weight compounds containing at least one hydroxyl group. The molecular weight is normally below 400. Examples of suitable solubilizers are propylene glycol methyl dipropylene glycol and ethyl diethylene glycol butyl diethylene glycol and butyl triethylene glycol.

When preparing a cooling lubricant according to the present invention, it is suitable to first prepare a concentrate, for example by first mixing the anionic compounds, I, II and II and water, and then the supplementary ingredients. The amount of water is suitably between 5 and 80% by weight of the concentrate. A typical concentrate according to the present invention has the following composition:

| | |
|---|---|
| anionic compounds I, II and III | 20–95, preferably 50–90% by weight |
| additional corrosion inhibitors | 0–30, preferably 0–15% by weight |
| additional lubricants | 0–30, preferably 0–15% by weight |
| water | 5–80, preferably 10–50% by weight |
| other ingredients | 0–30, preferably 0–15% by weight, |

the weight ratio between the components I and/or II and compound III being from 1:15 to 15:1, preferably from 1:5 to 5:1.

The total amount of the additional corrosion inhibitors, the additional lubricants and the other ingredients is often 5–40% by weight of the concentrate. Before the concentrate is used, it is diluted with water so that the cooling lubricant ready for use will have a total content of the anionic compounds I, II and III of 0.5–10% by weight, preferably 2–6% by weight.

DESCRIPTION OF THE PREFERRED EMBODIMENTS

The present invention is further illustrated by the following Example.

EXAMPLE

Three water-based lubricants A, B and C were prepared by adding 20 grams of octenyl succinic acid, 20 grams of n-buty-$(C_3H_6O)_{10}OPO_3H_2$, or 10 grams of octenyl succinic acid and 10 grams of n-butyl-$(C_3H_6O)_{10}OPO_3H_2$, respectively, to 980 grams of water of a water hardness of 17° dH. The pH value of the cooling lubricants were adjusted to 9 by addition of KOH. The lubrication and corrosion-inhibiting ability of the cooling lubricants were tested. The lubrication was determined by measuring the wear scar obtained in modified Timken machine using steel rings A4138 with an outer diameter of 35 mm. The tests were performed during 2 and 5 minutes at a temperature of 45° C. The corrosion of Fe, Al, Co, Cu and brass was determined by the following test methods.

Fe-corrosion tests were done by placing 30 grams of cast iron chips evenly spread on a circular filter paper with a diameter of 90 mm. 1.25 gram of one of the cooling lubricants was dispensed at the centre of the filter paper, which was placed in a plastic Petri dish and covered by a lid. The corrosion taken place after 24 hours was determined by visually inspection of the rust staining according to a scale, where 0=no corrosion, 1=one stain, 2=two or three stains, 3=more than three stains up to 10% of the paper surface discoloured, 4=between 10 and 25% of the paper surface discoloured, and 5=more than 25% of the paper surface discoloured.

Co and Cu corrosion tests were performed by assessing the amount of leached cobalt and copper obtained, when a 20 ml glass vial containing 5 glass beads, 5 mg of fine powder of cobalt or copper and 10 ml of one of the fluids was shaken for 7 days. The amount of cobalt or copper dissolved was measured by use of an atomic absorption spectrophotometer (AAS). Initial screening of the fluids was done by using analytical sticks from Merck and only samples, which were found to contain less than 30 ppm of cobalt or copper were subjected to AAS analysis.

Since brass and aluminium are often used in applications where visual appearance is important an immersion test was performed to show the degree of discoloration caused by the test solutions. Strips of 5 mm width and 60 mm length of each metal were placed in separate glass vials and tests solutions were added in an amount sufficient to cover half the length of the upright standing strips. The corrosion was visually determined after 7 days. The discoloration of the strips was measured according to a scale from 0 to 5, where 0 represent no corrosion, 1 indicate that up to 5% of the surface is black, 2 that 5–10% of the surface is black, 3 that 10–25% of the surface is black, 4 that 25–90% of the surface is black, and 5 that 90–100% of the surface is black.

The following results were obtained.

TABLE

Corrosion and Timken Tests

| Formulation | Corrosion | | | | | Timken, mm | |
|---|---|---|---|---|---|---|---|
| Symbol | Fe | M | Brass | Co | Cu | 2 min | 5 min |
| A | 0 | 0 | 0 | 0 | 5 | 0.97 | 1.07 |
| B | 4 | 0 | 1 | 0 | 10 | 0.83 | 1.17 |
| C | 0 | 0 | 0 | 0 | 5 | 0.83 | 1.03 |

From the results it is evident that the cooling lubricant C of the present invention has excellent anti-corrosion properties and is superior to the comparison compositions as regards the lubrication ability.

What is claimed is:

1. A method for the mechanical working of metals and alloys which comprises conducting the mechanical working in the presence of an aqueous cooling lubricant having a pH of 6–10 and containing a phosphate ester of the formula $$R_1(\text{oxyalkylene})_n OP(O)(X)(OH) \quad (I),$$

or $$(HO)_2(O)P\text{-}(\text{oxyalkylene})_m OP(O)(OH)_2 \quad (II),$$

where $R_1$ is an alkyl group with 1–12 carbon atoms, oxyalkylene is a group containing 2–4 carbon atoms, n is a number from 1–20, X is hydroxyl, $R_1O$ or $R_1(\text{oxyalkylene})_n O$, where $R_1$, oxyalkylene and n have the meanings mentioned above, and m is a number from 4–40, or a salt thereof, and an alkenyl substituted succinic acid of the formula $$HOOCCH(R_2)CH_2COOH \quad (III),$$

where $R_2$ is an alkenyl group with 4–10 carbon atoms, or a salt thereof, or a mixture of any of the compounds I, II and III.

2. The method according to claim 1 wherein $R_1$ in formula I contains 2–8 carbon atoms, the group $(\text{oxyalkylene})_n$ contains at least partially oxypropylene units and n is a number from 4–15.

3. The method according to claim 2 wherein the phosphate ester of formula I is n-butyl-$(OC_3H_6)_{10}OPO_3H_2$.

4. The method according to claim 1, wherein the phosphate ester of formula II is $$(HO)_2(O)P\text{-}(\text{oxypropylene})_{8\text{-}15}OP(O)(OH)_2.$$

5. The method according to claim 1, wherein $R_2$ in formula III is selected from the group consisting of octenyl, decenyl, diisobutenyl and tripropenyl.

6. The method according to claim 5 wherein the phosphate ester has the formula I, in which $R_1$ contains 2–8 carbon atoms, the $\text{group}(\text{oxyalkylene})_n$ contains at least partially oxypropylene units and n is a number from 5–15.

7. The method according to claim 5 wherein the phosphate ester is $$(HO)_2(O)P\text{-}(\text{oxypropylene})_{8\text{-}15}OP(O)(OH)_2.$$

8. The method according to claim 1 wherein the total amount of compounds I and II is from 0.2 to 5% by weight and the amount of compound III is from 0.2 to 5% by weight.

9. The method according to claim 6 wherein the total amount of compounds I and II is from 0.4 to 3% by weight and the amount of compound III is from to 3% by weight.

10. A concentrate, comprising Anionic compounds of the formula $$R_1(\text{oxyalkylene})_n OP(O)(X)(OH) \quad (I),$$

or $$(HO)_2(O)P\text{-}(\text{oxyalkylene})_m\text{—}OP(O)(OH)_2 \quad (II),$$

where $R_1$ is an alkyl group with 1–12 carbon atoms, oxyalkylene is a group containing 2–4 carbon atoms, n is a number from 1–20, X is hydroxyl, $R_1O$ or $R_1(\text{oxyalkylene})_n O$, where $R_1$, oxyalkylene and n have the meanings mentioned above, and m is a number from 4–40, or a salt thereof, and an alkenyl substituted succinic acid of the formula $$HOOCCH(R_2)CH_2COOH \quad (III),$$

where $R_2$ is an alkenyl group with 4–10 carbon atoms, or a salt thereof, or a mixture of any of the compounds I, II and Ill, which are present in a total amount of 20–95% by weight and further containing additional corrosion inhibitors in an amount of 0–30% by weight, additional lubricants in an amount of 0–30% by weight, water in an amount 5–80% by weight, and other ingredients in an amount of 0–30% by weight, the weight ration between the compounds I and/or II and compound II being from 1:15 to 15:1.

11. The concentrate according to claim 10 comprising wherein the anionic compounds I and II and II are present in a total amount of 50–90% by weight and further containing additional corrosion inhibitors in an amount of 0–15% by weight, additional lubricants in an amount of 0.15% by weights water in an amount of 10–50% by weight, the other ingredients in an amount of 0–15%, the weight ration between the compounds I and/or II and compound III being from 1:5 to 5:1.

12. The concentrate according to claim 11 wherein the total amount of the additional corrosion inhibitors, the additional lubricants and the other ingredients is from 5 to 40% by weight.

* * * * *